US005216610A

United States Patent [19]

Douta et al.

[11] Patent Number: 5,216,610

[45] Date of Patent: Jun. 1, 1993

[54] ENGINE ROTATION SPEED CONTROL APPARATUS HAVING AUXILIARY AIR CONTROLLER

[75] Inventors: Hisayo Douta, Kariya; Shinichi Iwamoto, Obu, both of Japan

[73] Assignee: Nippondenso Co., Ltd., Kariya, Japan

[21] Appl. No.: 639,084

[22] Filed: Jan. 9, 1991

[30] Foreign Application Priority Data

Jan. 12, 1990 [JP] Japan ..... 2-5540
May 18, 1990 [JP] Japan ..... 2-129857

[51] Int. Cl.[5] ..... F02M 23/06; F02M 23/08

[52] U.S. Cl. ..... 364/431.05; 364/431.07; 123/339; 123/585

[58] Field of Search ..... 123/339, 585, 586, 587, 123/325, 493; 364/431.05, 431.07, 431.08, 431.10, 431.01, 431.03, 431.04

[56] References Cited

U.S. PATENT DOCUMENTS 4,240,145 12/1980 Yano et al. ..... 364/431.07
4,513,713 4/1985 Koumura ..... 123/585 X
4,557,234 12/1985 Ito ..... 123/339
4,570,592 2/1986 Otobe ..... 123/585 X
4,640,244 2/1987 Koike et al. ..... 123/585 X
4,660,519 4/1987 Stocker et al. ..... 364/431.07 X
4,700,674 10/1987 Iwata ..... 123/585 X
4,777,918 10/1988 Yasuoka ..... 123/339
4,840,156 6/1989 Yamato et al. ..... 123/339
4,856,475 8/1989 Shimomura et al. ..... 123/339
4,860,707 8/1989 Ohata ..... 123/339
4,903,658 2/1990 Miyama et al. ..... 123/339

FOREIGN PATENT DOCUMENTS 61-25941 2/1986 Japan .
61-197736 9/1986 Japan .
62-253941 11/1987 Japan .
1-121536 5/1989 Japan .

*Primary Examiner*—Parshotam S. Lall
*Assistant Examiner*—Thomas S. Auchterlonie
*Attorney, Agent, or Firm*—Cushman, Darby & Cushman

[57] ABSTRACT

An engine speed control apparatus having an auxiliary air amount controller is disclosed. The apparatus has an actuator which is attached to an engine intake manifold so as to bypass a throttle valve and controls a flow rate of an auxiliary air and a control unit for driving the actuator. The control unit detects whether an engine is in an idling state or not on the basis of a combination of an engine rotational speed and other information. When the idling state is detected, a target value of an intake pressure on the downstream side of the throttle valve is set in accordance with the engine speed at that time. The control unit drives and controls the actuator so that the actual intake pressure coincides with the target value. Thus, when the operating mode of the engine is shifted from the non-idling state to the idling state, an air amount which is required by the engine can be accurately supplied and the engine speed can be rapidly converged to the target value.

17 Claims, 12 Drawing Sheets

FIG. 4A
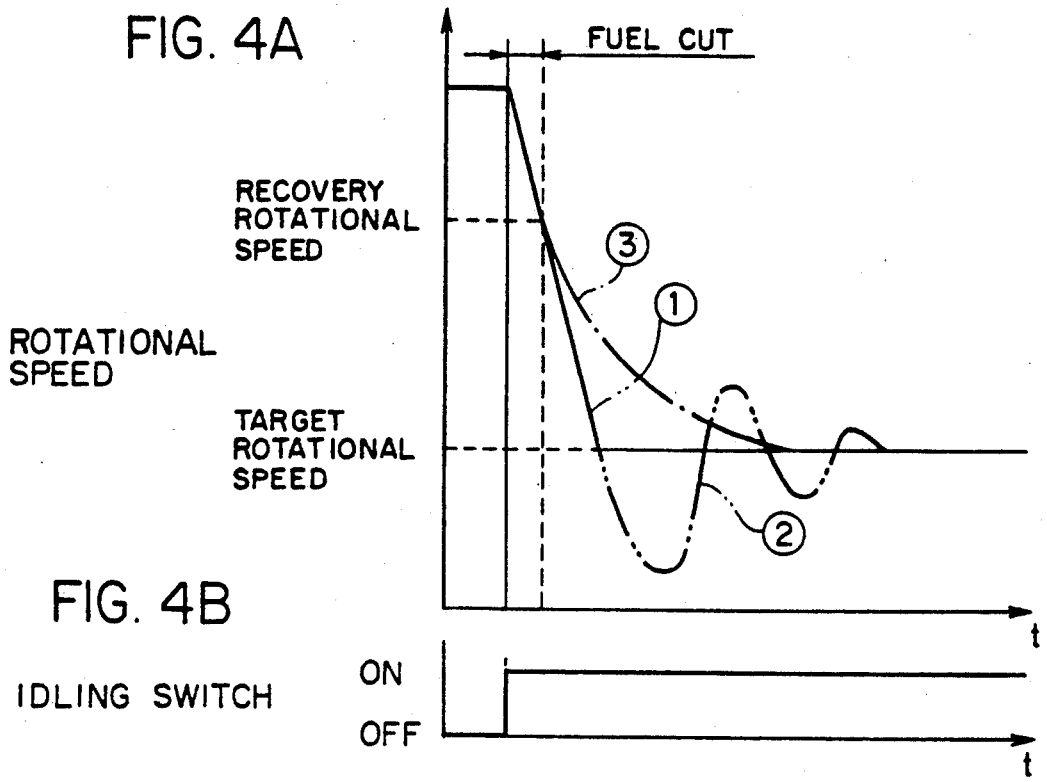
FIG. 4B
FIG. 5
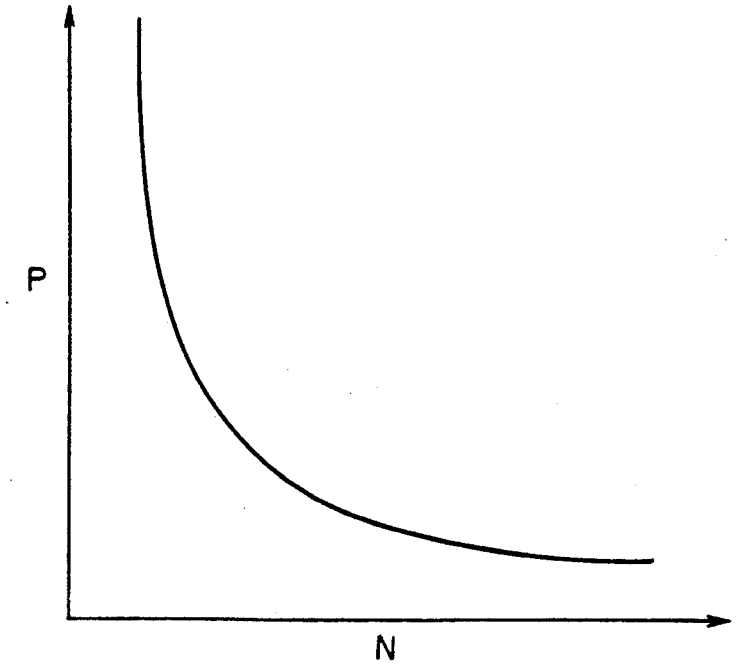

ENGINE ROTATION SPEED CONTROL APPARATUS HAVING AUXILIARY AIR CONTROLLER

BACKGROUND OF THE INVENTION

Field of the Invention

The present invention relates to an engine speed control apparatus having an auxiliary air amount controller for controlling an amount of auxiliary air which is supplied to the engine from an auxiliary air passage provided so as to bypass a throttle valve which is arranged in an intake pipe of the engine and, more particularly, to the control of an auxiliary air amount upon shifting from a non-idling state of the engine to an idling state.

Description of the Related Art

Hitherto, there has been disclosed an auxiliary air amount controller for an engine for setting a control gain in accordance with a reduction ratio of a rotational speed in order to prevent a decrease in rotational speed when shifting from the non-idling state of the engine to the idling state and to improve a converging performance toward a target engine speed (for instance, JP-A-62-253941 and the like).

However, the controller to control the auxiliary air amount in accordance with the reduction ratio of the rotational speed as mentioned above merely executes a forward control. That is, an air amount (necessary air amount) which is needed by the engine in order to prevent a decrease in rotational speed upon shifting from the non-idling state of the engine to the idling state and to improve the converging performance to the target engine speed differs depending on a difference of the engine, an engine state, and the like. Therefore, there is a problem such that it is difficult to accurately control the auxiliary air amount so as to obtain the necessary air amount. Further, in an engine with a supercharger having a large intake volume which has recently widely been spread, a lack amount of the air amount for the air amount which is necessary upon shifting from the non-idling state of the engine to the idling state, that is, the auxiliary air amount is large. Therefore, according to the forward control as mentioned above, it is impossible to control the air amount to the necessary air amount.

SUMMARY OF THE INVENTION

The invention is made in consideration of the above problems and it is an object of the invention to provide an engine speed control apparatus with an auxiliary air amount controller for an engine which can accurately control an air amount which is supplied to the engine to a necessary air amount upon shifting from the non-idling state of the engine to the idling state.

FIG. 1A shows a first block diagram of the invention which provides an engine speed control apparatus with an engine auxiliary air amount controller having an actuator which is arranged in an auxiliary air passage for leading an auxiliary air from the upstream side of a throttle valve arranged in an intake manifold of the engine to the downstream side of the throttle valve by bypassing the throttle valve and adjusts a flow rate of the auxiliary air and actuator control means for controlling the actuator so that intake information in the downstream of the throttle valve coincides with a target value, wherein the actuator control means comprises:

rotational speed detecting means for detecting an engine speed;

control start timing detecting means for detecting a timing to start a control by the actuator control means in accordance with the engine state; and target value setting means for setting the target value of the intake information in accordance with the rotational speed at the control start timing which is detected.

FIG. 1B shows a second block diagram of the invention which provides an engine speed control apparatus with an engine auxiliary air amount controller having an actuator which is arranged in an auxiliary air passage for leading an auxiliary air from the upstream side of a throttle valve which is arranged in an intake manifold of the engine to the downstream side of the throttle valve by bypassing the throttle valve and adjusts a flow rate of the auxiliary air and actuator control means for controlling the actuator so that intake information in the downstream of the throttle valve coincides with a target value, wherein the actuator control means comprises:

intake information detecting means for detecting means for detecting the intake information; and control amount setting means for setting a control amount of the actuator in accordance with a time differentiation value of the target intake information and a time differentiation value of the intake information.

According to the first invention which is constructed as mentioned above, in the actuator control means, the target value of the intake information is set by the target value setting means in accordance with the rotational speed at the timing to start the control by the actuator control means which is detected by the control start timing detecting means in accordance with the engine state. The actuator is controlled so that the intake information coincides with the target intake information.

On the other hand, according to the second invention which is constructed as mentioned above, a control amount of the actuator is set by the control amount setting means in accordance with the time differentiation value of the target value of the intake information and the time differentiation value of the intake information.

As described in detail above, according to the first invention, when the feedback control is started, the target intake pressure is set in accordance with the time differentiation value of the rotational speed in a discriminating step. The auxiliary air amount is controlled so that the intake pressure coincides with the target intake pressure. Therefore, upon shifting from the non-idling state to the idling state, the air amount can be accurately controlled to an air amount which is required by the engine. Thus, there are excellent effects such that a decrease in rotational speed can be prevented and the converging performance to the target rotational speed can be improved.

On the other hand, according to the second invention, the auxiliary air amount is set in accordance with the time differentiation value of the target intake pressure and the time differentiation value of the intake pressure, so that the intake pressure can be accurately controlled to the target intake pressure. Consequently, there is an excellent effect such that the air amount can be accurately controlled to an air amount which is required by the engine.

BRIEF DESCRIPTION OF THE DRAWINGS

FIGS. 4A & B are a timing chart of a rotational speed;

FIG. 5 is a characteristic diagram of a contour line for an equal quantity delivery of air;

DESCRIPTION OF THE PREFERRED EMBODIMENTS

Several embodiments to which the invention was applied will be described hereinbelow with reference to the drawings.

Figure 1A:
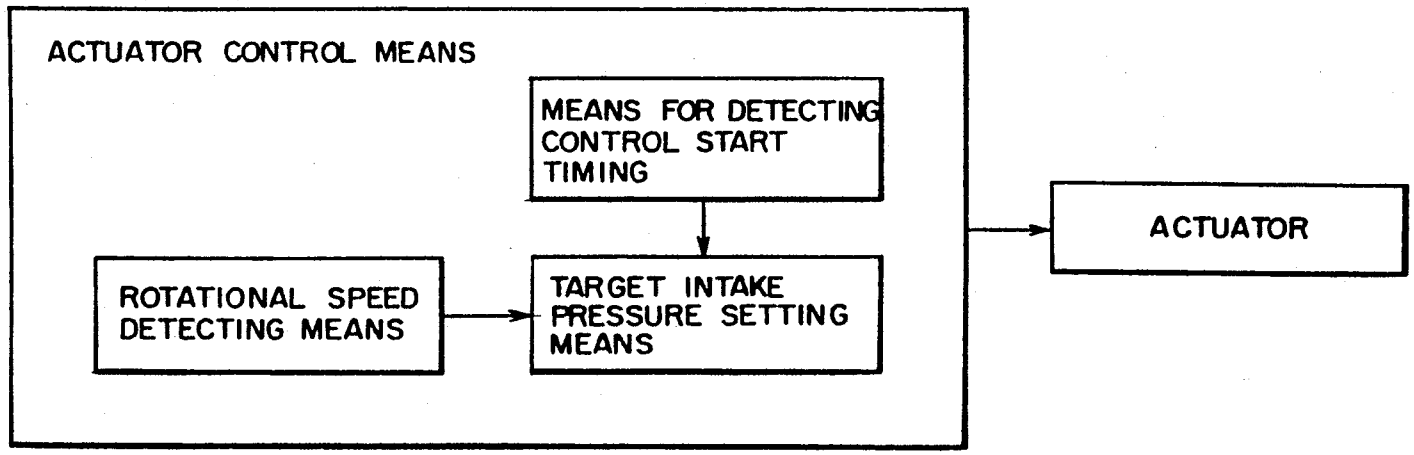
FIGS. 1A and 1B are block diagrams for explaining the claimed inventions.
Figure 1B:
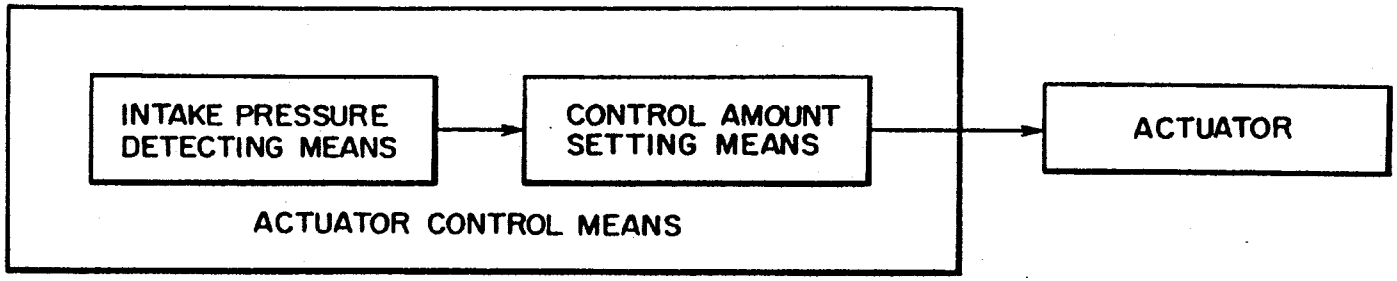
Figure 2:
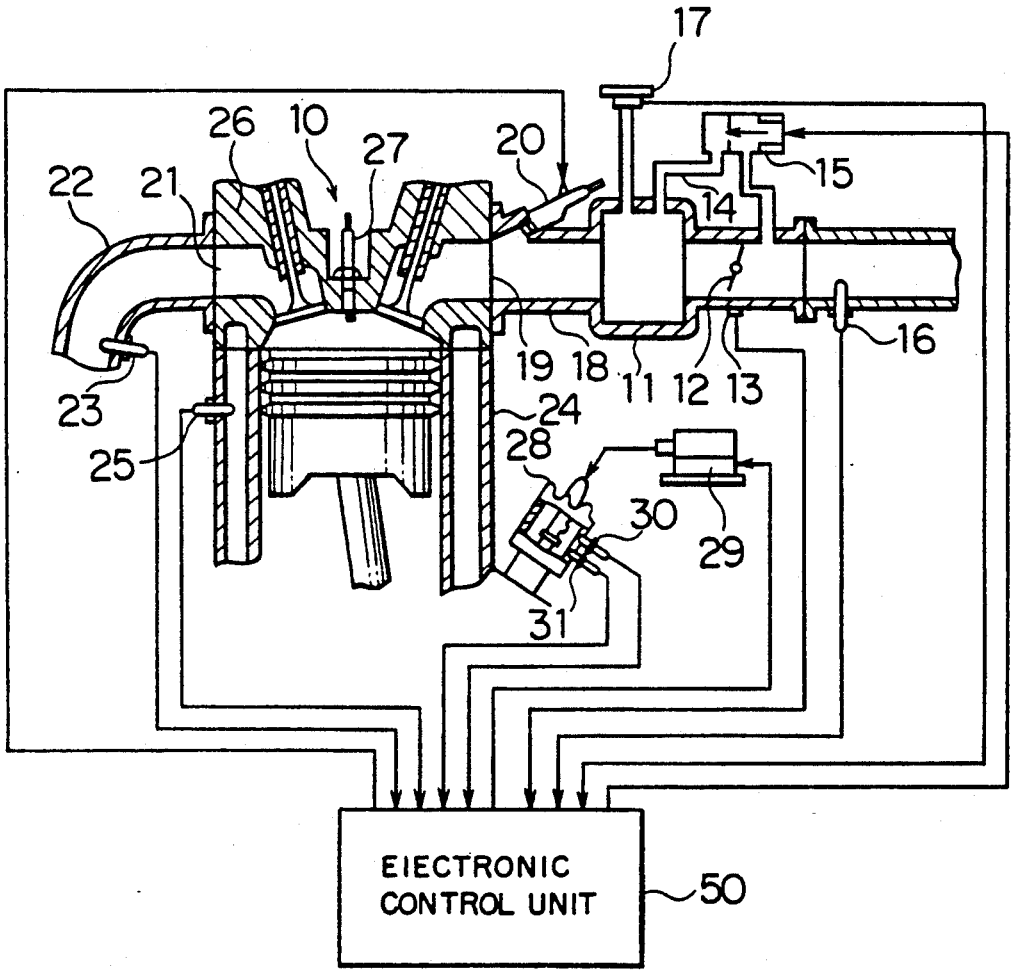
FIG. 2 is a constructional diagram regarding an embodiment of the invention.

FIG. 2 is a constructional diagram of an embodiment. In an exhaust system of an engine 10, a throttle valve 12 is arranged on the upstream side of a surge tank 11 and an idling switch 13 which is turned on when the throttle valve 12 is in a full-closed state is attached. An auxiliary air passage 14 is provided so as to supply the air from the upstream side of the throttle valve to the surge tank 11 on the downstream side of the throttle valve by bypassing the throttle valve 12. An idling control valve (ISC valve) 15 for controlling an auxiliary air amount is arranged in the auxiliary air passage 14. A well-known proportional electromagnetic type (linear solenoid) control valve or vacuum switching valve (VSV) or the like is properly used as the ISC valve 15. A temperature sensor 16 for detecting an intake air temperature is attached on the upstream side of the throttle valve 12. Further, a pressure sensor 17 for detecting an intake pressure P in the downstream of the throttle valve 12 is attached to the surge tank 11. Further, the surge tank 11 is communicated with a combustion chamber of the engine 10 via an intake manifold 18 and an intake port 19. A fuel injection valve 20 is attached to every cylinder so as to be projected into the intake manifold 18.

On the other hand, the combustion chamber of the engine 10 is connected to a 3-way catalytic converter (not shown) via an exhaust port 21 and an exhaust manifold 22. An $O_2$ sensor 23 for detecting a residual oxygen concentration in the exhaust gas and outputting an air-fuel ratio signal is attached to the exhaust manifold 22. A water temperature sensor 25 is attached to an engine block 24 so as to penetrate the engine block 24 and project into a water jacket in order to detect a temperature of a cooling water for the engine 10.

Further, a spark plug 27 is attached to every cylinder so as to penetrate through cylinder head 26 of the engine 10 and project into the combustion chamber. The spark plug 27 is connected to an electronic control unit (ECU) 50 comprising a microcomputer or the like through a distributor 28 and an igniter 29. A cylinder discriminating sensor 30 and a crank angle sensor 31 each of which is constructed by a signal rotor fixed to a distributor shaft and a pickup fixed to a distributor housing are attached in the distributor 28. In the case of a 6-cylinder engine, the cylinder discrimination sensor 30 outputs a cylinder discrimination signal, for instance, every 720° CA and the crank angle sensor 31 outputs a rotational speed signal, for example, every 30° CA.

Figure 3:
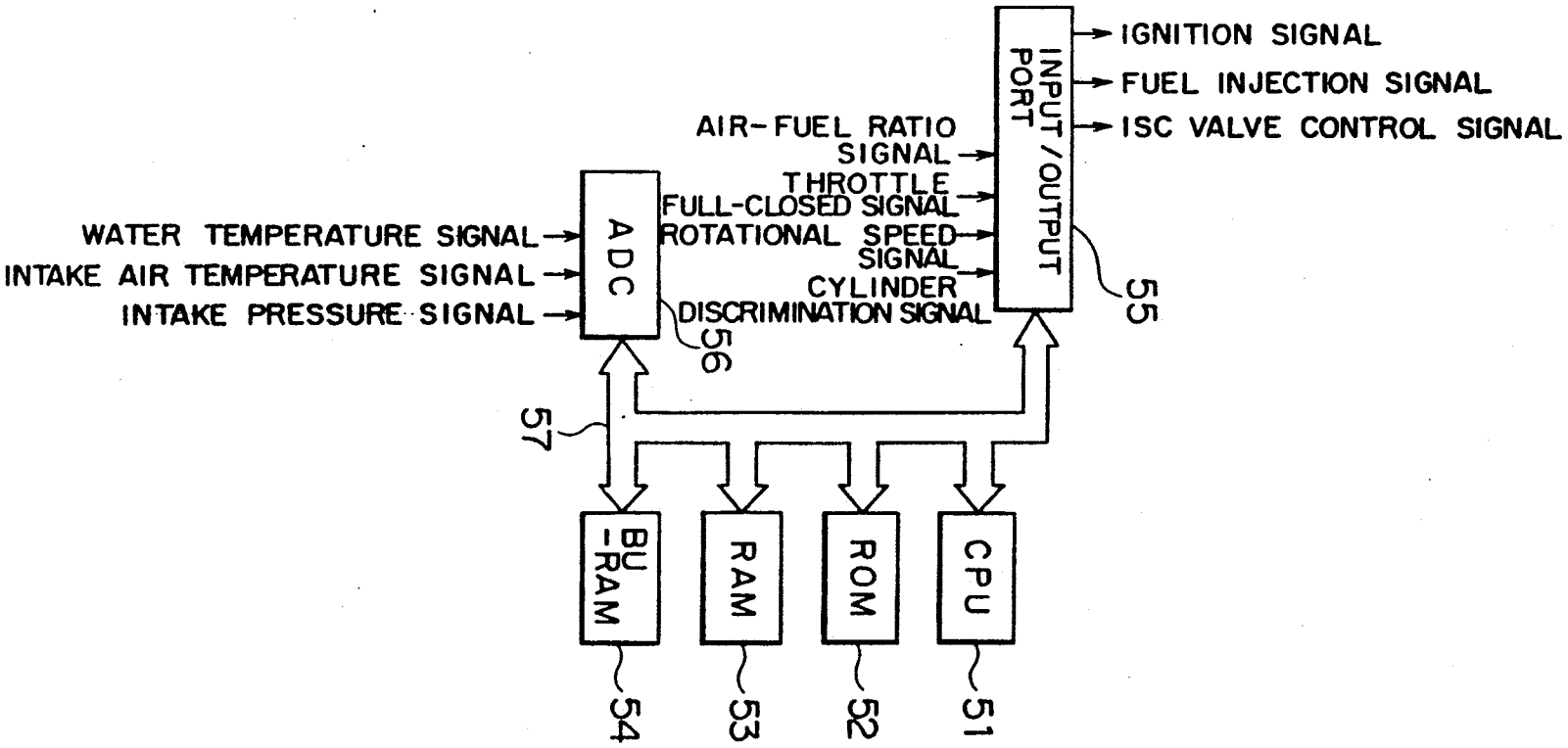
FIG. 3 is a constructional diagram of an electronic control unit.

As shown in FIG. 3, the ECU 50 is constructed so as to include: a central processing unit (CPU) 51; a read only memory (ROM) 52; a random access memory (RAM) 53; a backup RAM (BU-RAM) 54; an input/output port 55; an analog/digital converter (ADC) 56; and a bus 57 such as data bus, control bus, and the like for connecting the above components. The cylinder discrimination signal, rotational speed signal, throttle full-close signal, and air-fuel ratio signal are input to the input/output port (I/O port) 55. The I/O port 55 outputs an ISC valve control signal to open or close the ISC valve 15, a fuel injection signal to open or close the fuel injection valve 20, and an ignition signal to turn on or off the igniter 29 to a driving circuit (not shown). In accordance with the above output signals, the driving circuit controls the ISC valve 15, fuel injection valve 20, and igniter 29, respectively.

On the other hand, an intake pressure signal, an intake air temperature signal, and a water temperature signal are input to the ADC 56. The ADC 56 sequentially converts the above signals into the digital signals in accordance with commands from the CPU 51.

The control of the auxiliary air amount will now be described hereinbelow.

The setting of the auxiliary air amount will be first explained.

By time-differentiating both sides of a state equation $P=\gamma RT$ of a gas (where, P: pressure, $\gamma$: density, R: atmospheric pressure constant, T: temperature), $$dP/dt = RT \times d\gamma/dt$$

is obtained. The time differentiation value $d\gamma/dt$ of the density is given by the following equation.

$$d\gamma/dt = (G_{IN} - G_{OUT})/V_s$$

(where, $G_{IN}$: throttle passing air amount, $G_{OUT}$: engine intake air amount, $V_S$: capacity of the surge tank)

Therefore, the throttle passing air amount $G_{IN}$ is expressed by the following equation.

$$G_{IN} = \frac{V_S}{RT} \cdot \frac{dP_t}{dt} + G_{OUT}$$

In the case of controlling the intake pressure to a target intake pressure $P_t$ by supplying an auxiliary air amount $G_{ISC}$, the following equation is derived.

$$G_{IN} + G_{ISC} = \frac{V_S}{RT} \cdot \frac{dP_t}{dt} + G'_{OUT}$$

Since the engine intake air amount is constant ($G_{OUT} = G'_{OUT}$), the auxiliary air amount $G_{ISC}$ which is necessary to control the intake pressure P to the target intake pressure $P_t$ is expressed by the following equation.

$$G_{ISC} = \frac{V_S}{RT} \cdot \left( \frac{dP_t}{dt} - \frac{dP}{dt} \right) \quad (1)$$

That is, the auxiliary air amount $G_{ISC}$ is determined in accordance with a difference between the time differentiation value $dP_t/dt$ of the target intake pressure $P_t$ and the time differentiation value $dP/dt$ of the intake pressure P. On the other hand, since the temperature T is almost constant, $V_S/RT$ can be considered to be a constant.

The setting of the target intake pressure $P_t$ will now be described.

FIGS. 4A & B show a timing chart of the rotational speed in the deceleration fuel cutting mode. A solid line (1) in (a) in FIG. 4A shows the ideal behavior of the rotational speed. That is, the rotational speed decreases to the target rotational speed and, thereafter, it is maintained to the target rotational speed.

When the auxiliary air amount $G_{ISC}$ is small (or the auxiliary air is not supplied), the rotational speed decreases as shown by an alternate long and two short dashed line (2) in (a) in FIG. 4A. On the contrary, when the auxiliary air amount $G_{ISC}$ is large, a converging speed to the target rotational speed becomes slow as shown by an alternate long and short dash line (3) in (a) in FIG. 4A.

Therefore, the target intake pressure $P_t$ is set to the intake pressure when the rotational speed exhibits ideal behavior (ideal rotational speed) as mentioned above. The ideal rotational speed linearly decreases until the target rotational speed here. That is, the ideal rotational speed can be set in accordance with the time differentiation value of the rotational speed just before the engine is returned from the fuel cutting mode. On the other hand, FIG. 5 shows the relation (contour line for an equal quantity delivery of air) between the rotational speed N and the intake pressure P for supplying an air amount which is necessary to maintain a stationary state in the idling mode.

Therefore, the target intake pressure $P_t$ can be set on the basis of the contour line for an equal quantity delivery of air from the ideal rotational speed which is presumed in accordance with the time differentiation value of the rotational speed just before the engine is returned from the fuel cutting mode.

The operation of the first embodiment will be described on the basis of the flowchart shown in FIG. 6.

First, a state of the idling switch 13 is detected in step 90. Only when the idling switch 13 is on, the control of the auxiliary air amount in step 100 and subsequent step is executed.

In step 100, the intake pressure P which is detected by the pressure sensor 17 and the rotational speed N which is calculated on the basis of the detection signal of the crank angle sensor 31 are read. In step 101, a check is made to see if the fuel is in the cutting state or not. If the fuel is in the cutting state, it is determined that the operating mode is in the non-idling state, so that step 102 follows. In step 102, the rotational speed N is set to an ideal rotational speed $N_e$ as a parameter to set the initial value of the target intake pressure $P_t$ in the feedback control of the auxiliary air amount. Then, step 103 follows.

If the fuel is not in the cutting state in step 101, the processing routine advances to step 104 and a check is made to see if the intake pressure P is equal to a predetermined pressure (for instance, intake pressure in the idling stable state or the like) $P_{IDL}$ or not. If the intake pressure P is equal to or higher than the predetermined value $P_{IDL}$, step 103 follows without executing the feedback control of the auxiliary air amount. In step 103, the auxiliary air amount $G_{ISC}$ is set to a predetermined amount (for example, learning value of the auxiliary air amount in the idling state) $G_{LRN}$. That is, the auxiliary air amount $G_{ISC}$ in the case where the feedback control is not executed is set to the predetermined amount $G_{LRN}$.

On the other hand, if it is determined in step 104 that the intake pressure P is smaller than the predetermined pressure $P_{IDL}$, the feedback control in step 105 and subsequent steps is performed. First, in step 105, a state of a flag FCUT is detected. The flag FCUT is reset (FCUT←0) when the fuel is cut. The flag FCUT is set (FCUT←1) when the feedback control is started. If the flag FCUT is not set, it is determined that the engine was returned from the fuel cutting state at the present control timing, that is, the operating mode was shifted from the non-idling state to the idling state, thereby starting the feedback control. First, in step 106, a deviation between the rotational speed N at the present control timing and a rotational speed $N_0$ at the preceding control timing is set as a time differentiation value $\Delta N$ ($\leftarrow N \times N_0$) of the rotational speed. In step 107, the flag FCUT is set (FCUT←1) and step 108 follows.

If it is decided in step 105 that the flag FCUT has been set, namely, when the engine has already been set into the idling state, the processes in steps 106 and 107 are not executed but step 108 follows. In step 108, the target rotational speed $N_e$ is set by the following equation.

$$N_e \leftarrow N_e + \Delta N$$

In the next step 109, the target intake pressure $P_t$ is set in accordance with the ideal rotational speed $N_e$ from the contour line for an equal quantity delivery of air shown in FIG. 5 as mentioned above. In step 110, a deviation between the intake pressure P at the present control time and the intake pressure $P_0$ at the preceding control time is set as a time differentiation value $\Delta P$ ($\leftarrow P - P_0$) of the intake pressure. Then, in step 111, a deviation between the target intake pressure $P_t$ which was set at the present control time and a target intake pressure $P_{to}$ which was set at the preceding control time is set as a time differentiation value $\Delta P_t$ ($\leftarrow P_t - P_{t0}$) of the target intake pressure.

In step 112, the auxiliary air amount $G_{ISC}$ is set by the following equation in accordance with the time differentiation value $\Delta P_t$ of the target intake pressure and the time differentiation value $\Delta P$ of the intake pressure on the basis of the equation (1).

$$G_{ISC} \leftarrow G_{ISC} + K \cdot (\Delta P_t - \Delta P)$$

where, K is a constant.

In this manner, the control routine of the auxiliary air amount $G_{ISC}$ is finished.

A control signal (duty signal) corresponding to the auxiliary air amount $G_{ISC}$ which was set as mentioned above is output to the ISC valve 15.

In the control, a state in which the idling switch 13 is on and the fuel is not in the cutting state is called an idling state.

From the above control, the auxiliary air amount $G_{ISC}$ is supplied so that the intake pressure P is equal to the target intake pressure $P_t$. The target intake pressure $P_t$ is set in accordance with the ideal rotational speed $N_e$ which is set on the basis of the time differentiation value $\Delta N$ of the rotational speed when the engine is returned from the fuel cutting state, that is, when shifting from the non-idling state to the idling state. Therefore, the auxiliary air amount $G_{ISC}$ can be controlled so that the intake pressure P provides the ideal rotational speed $N_e$.

The auxiliary air amount $G_{ISC}$ is set in accordance with the time differentiation value $dP_t/dt$ of the target intake pressure $P_t$ and the time differentiation value dP/dt of the intake pressure P. Therefore, the intake pressure P can be accurately controlled to the target intake pressure $P_t$.

Thus, a decrease in rotational speed upon shifting from the non-idling state to the idling state can be prevented and the converging performance to the target rotational speed can be improved.

On the other hand, in the first embodiment, the auxiliary air amount $G_{ISC}$ is set in accordance with the time differentiation value $\Delta P_t$ of the target intake pressure and the time differentiation value $\Delta P$ of the intake pressure. However, the auxiliary air amount $G_{ISC}$ can be also set in accordance with the difference between the target intake pressure $P_t$ and the intake pressure P. The second embodiment will now be described hereinbelow with reference to a flowchart shown in FIG. 7. In the second embodiment, the processes in steps 201 to 203 are executed in place of the processes in steps to 112 in the flowchart shown in FIG. 6. The processes in steps 100 to 109 are the same as those in FIG. 6. Therefore, the description regarding the processes in steps 100 to 109 is omitted.

In step 201, the magnitude of the target intake pressure $P_t$ which was set in step 109 is compared with the magnitude of the intake pressure P. If the intake pressure P is larger than the target intake pressure $P_t$, the auxiliary air amount $G_{ISC}$ is set in step 202 by the following equation.

$$G_{ISC} \leftarrow G_{ISC} + K_1 \cdot (P_t - P)$$

where, $K_1$ is a first proportional constant.

On the other hand, if it is determined in step 201 that the intake pressure P is equal to or lower than the target intake pressure $P_t$, the auxiliary air amount $G_{ISC}$ is set in step 203 by the following equation.

$$G_{ISC} \leftarrow G_{ISC} + K_2 \cdot (P_t - P)$$

where, $K_2$ is a second proportional constant which satisfies the relation of $K_2 > K_1 > 0$.

Therefore, when the intake pressure P is smaller than the target intake pressure $P_t$, in order to prevent a decrease in rotational speed, the integration constant is set to a larger value, thereby controlling so as to rapidly reach the target intake pressure $P_t$.

Further, in the first embodiment, the target intake pressure $P_t$ has been set every predetermined control timing on the basis of the ideal rotational $N_e$, thereby obtaining the time differentiation value $\Delta P_t$ of the target intake pressure from the deviation between the intake pressure P and the target intake pressure $P_t$. However, the time differentiation value $\Delta P_t$ of the target intake pressure can be also set by the time differentiation value $\Delta N$ of the rotational speed when the engine is returned from the fuel cutting state. The third embodiment will be described hereinbelow on the basis of a flowchart shown in FIG. 8.

Figure 6:
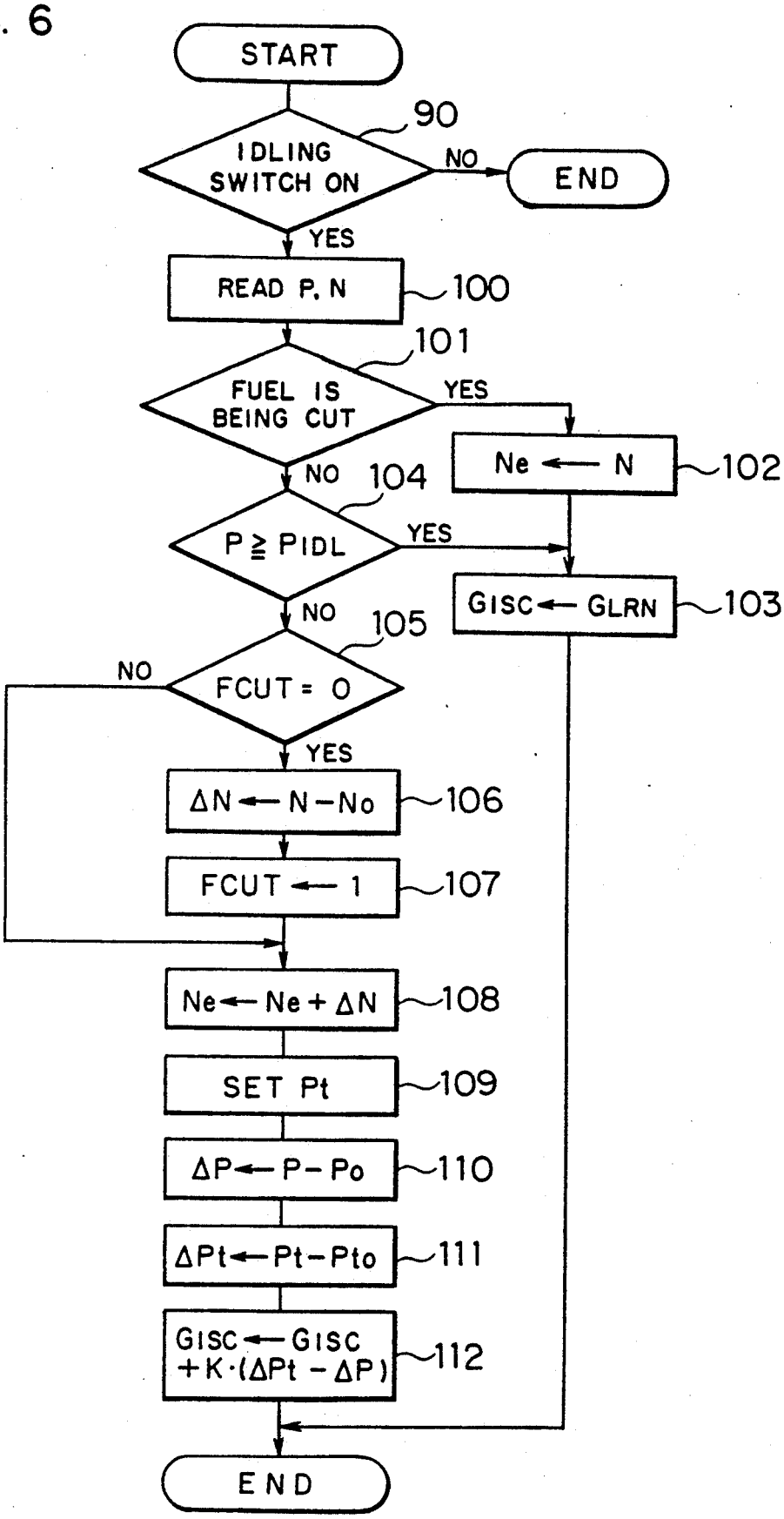
FIG. 6 is a flowchart for explaining the operation of the first embodiment.
Figure 7:
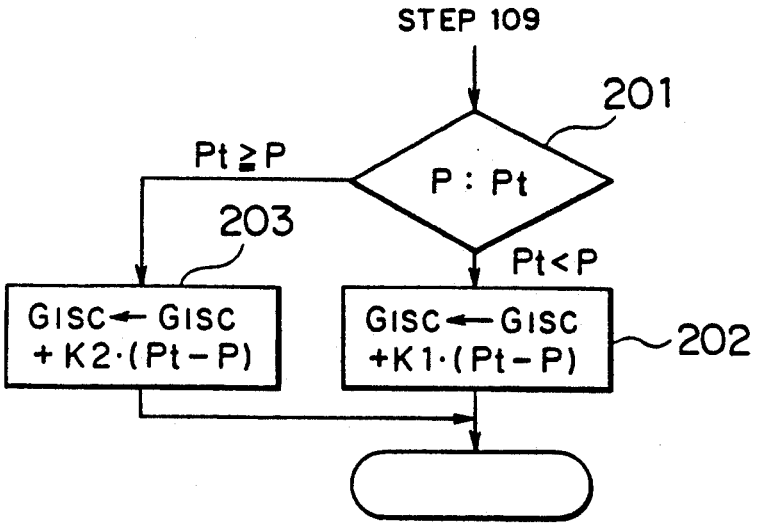
FIG. 7 is a flowchart for explaining the operation of the second embodiment.

In the third embodiment, the processes in steps 105 to 302 are executed in place of the processes in steps 105 to 111 in the flowchart of FIG. 6 and the other process are the same as those in FIG. 6. Therefore, the description of the other processes is omitted here.

First, in step 105, a state of the flag FCUT is detected in a manner as mentioned above. If the flag FCUT has been set (FCUT=1), step 302 follows.

Figure 9:
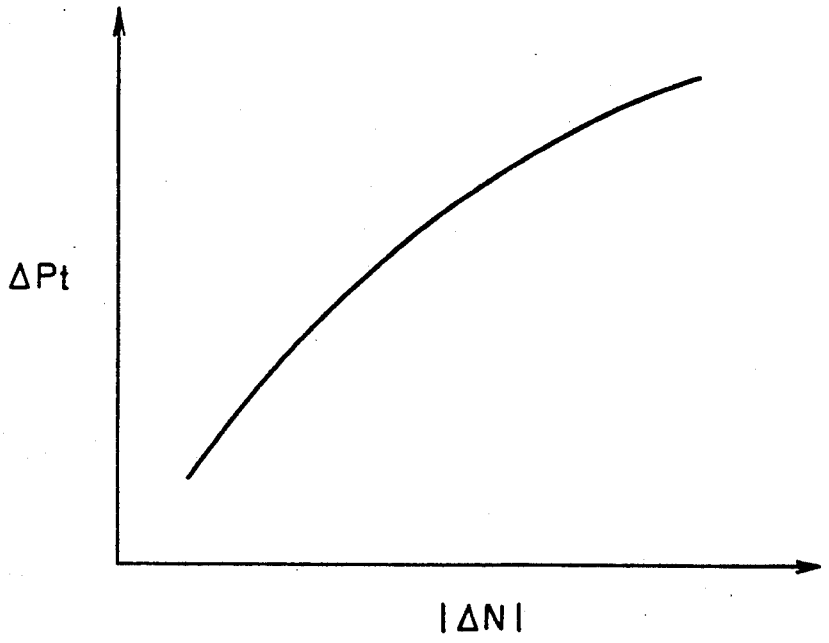
FIG. 9 is a characteristic diagram of a time differentiation value of a target intake pressure.

On the other hand, if the flag FCUT has been reset (FCUT=0) in step 105, the time differentiation value $\Delta N$ of the rotational speed is set in step 106 as mentioned above. In the next step 301, the target intake pressure $\Delta P_t$ is set in accordance with the time differentiation value $\Delta N$ of the rotational speed. FIG. 9 shows a characteristic diagram between the time differentiation value $\Delta N$ of the rotational speed and the target intake pressure $\Delta P_t$.

In step 107, the flag FCUT is then set (FCUT ←1). In step 302, the time differentiation value $\Delta P$ ($\leftarrow P - P_0$) of the intake pressure is set. The process in step 112 in FIG. 6 is executed.

On the other hand, in all of the above embodiments, the auxiliary air amount $G_{ISC}$ has been controlled only in the case of cutting the fuel upon deceleration. However, it will be obviously understood that the auxiliary air amount can be also controlled upon shifting from the non-idling state in which the fuel is not cut to the idling state as in the case of the deceleration at a low speed. The fourth embodiment will now be described hereinbelow on the basis of a flowchart shown in FIG. 10. In the fourth embodiment, the processes in steps 401 to 403 are executed between steps 106 and 107 in the flowchart shown in FIG. 6 and the process in step 90 is omitted. The other processes are the same as those in the flowchart of FIG. 6. Therefore, only the processes in steps 401 to 403 in FIG. 10 will be described.

First, in step 401, the ideal rotational speed $N_e$ is set. In the next step 402, the target intake pressure $P_t$ is set in accordance with the ideal rotational speed $N_e$ as mentioned above. In step 403, the magnitude of the intake pressure P is compared with the magnitude of the target intake pressure $P_t$. When the intake pressure P is larger than the target intake pressure $P_t$, it is decided that the operating mode is in the non-idling state, so that the processing routine advances to step 103 without executing the feedback control.

On the contrary, if the intake pressure P is equal to or less than the target intake pressure $P_t$ in step 403, it is determined that the operating mode is in the idling state, so that step 107 follows to execute the feedback control. The subsequent processes are performed. On the other hand, the flag FCUT in the fourth embodiment is set in the idling state and is reset in the non-idling state.

Further, the fifth embodiment to which the invention was applied will now be described on the basis of a flowchart shown in FIG. 11. The control routine is started and executed ever predetermined time (for instance, 100 msec in the embodiment).

First, a state of the idling switch 13 is detected in step 500. If the idling switch 13 is off, the control amount calculating routine in step 504 and subsequent steps is not executed but the processing routine advances to step 502. In step 502, a flag MODE1 indicative of the control state of the ISC valve 15 is set to 0 (MODE- 1←0) and the control routine is finished. That is, if the flag MODE1 has been set to 0, this means a state in which the calculation of the control amount $G_{ISC}$ is not performed.

On the contrary, if the idling switch 13 is on in step 500, the control amount calculating routine in step 504 and subsequent steps is executed. In step 504, the intake pressure P which is detected by the pressure sensor 17 and the rotational speed N which is calculated on the basis of the detection signal of the crank angle sensor 31 are read. In step 506, the state of the flag MODE1 is detected. If the flag MODE1 has been set to 0, that is, if the idling switch 13 was changed from the off state to the on state at the present control timing, in other words, in the case of starting the calculation of the control amount $G_{ISC}$ form the present control timing, the processing routine advances to step 508.

Steps 508 to 516 relate to the initializing routine. First, in step 508, a predetermined control amount $G_{LRN}$ is set in accordance with a load state of the engine 10 and step 510 follows In detail, as will be explained hereinlater, a learning control amount corresponding to the load state at that time among learning Control amounts $G_{LRN1}$, $G_{LRN2}$, and $G_{LRN3}$ stored in the BU-RAM 54 is set as a predetermined control amount $G_{LRN}$ in accordance with the load state (an operating state of an air conditioner, an electrical load state, etc.) of the engine 10 as will be explained hereinlater. The predetermined Control amount $G_{LRN}$ which was set in step 508 is set as a control amount $G_{ISC}$ in step 510.

Figure 8:
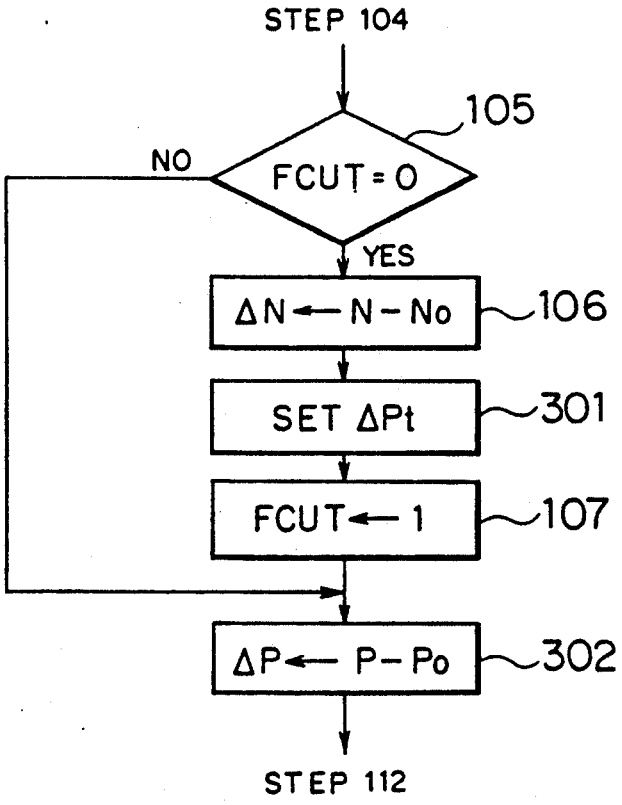
FIG. 8 is a flowchart for explaining the operation of the third embodiment.
Figure 10:
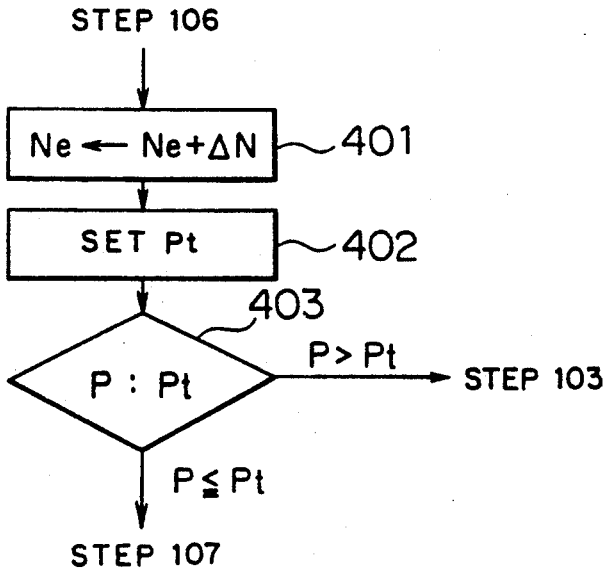
FIG. 10 is a flowchart for explaining the operation of the fourth embodiment.

The target intake pressure $P_t$ is set in step 512, in a manner similar to the foregoing embodiments (step 109 in FIG. 6, step 301 in FIG. 8, step 402 in FIG. 10). In the next step 516, an intake pressure deviation DP is reset (DP←0). The intake pressure deviation DP is a deviation between the time differentiation value $\Delta P_t$ of the target intake pressure and the time differentiation value $\Delta P_r$ of the intake pressure as will be explained hereinlater. The control amount $G_{ISC}$ is set in accordance with the intake pressure deviation DP. In step 516, the flag MODE1 is set to "1" (MODE1←1) and the control routine is finished. That is, when the flag MODE1 is set to 1, this means a state in which the calculation of the control amount $G_{ISC}$ has been executed.

On the other hand, if the flag MODE1 is not set to 0 in step 506, step 518 follows and a check is made to see if the flag MODE1 has been set to 1 or not. If the flag MODE1 has been set to 1, namely, in the case of executing the calculation of the control amount $G_{ISC}$, step 520 follows.

In step 520, the time differentiation value $\Delta P_r$ of the intake pressure is calculated ($\Delta P_r \leftarrow P0 - P$: where, P0 denotes an intake pressure at the preceding control timing). In step 522, the target intake pressure $P_t$ is set in a manner similar to step 512. In step 524, the time differentiation value $\Delta P_t$ of the target intake pressure is calculated ($\Delta P_t \leftarrow P_t0 - P_t$: where, $P_t0$ denotes a target intake pressure at the preceding control timing).

In step 526, a check is made to see if the time differentiation value $\Delta P_r$ of the intake pressure is equal to or larger than 0 or not. If the time differentiation value $\Delta P_r$ of the intake pressure is equal to or larger than 0, step 528 follows. A deviation between the time differentiation value $\Delta P_t$ of the target intake pressure and the time differentiation value $\Delta P_r$ of the intake pressure is substituted for the intake pressure deviation DP ($DP \leftarrow \Delta P_t - \Delta P_r$) and step 532 follows. On the other hand, if the time differentiation value $\Delta P_r$ of the intake pressure is less than 0 in step 526, step 530 follows. In step 530, the intake pressure deviation DP is reset (DP←0) and step 532 follows.

The control amount $G_{ISC}$ is set in accordance with the intake pressure deviation DP in step 532. In detail, the intake pressure deviation DP is increased by a predetermined number (K) of times, the resultant value is added to a control amount $G_{ISC}0$ at the preceding control timing, and the resultant value is set to the control amount $G_{ISC}$ ($G_{ISC} \leftarrow G_{ISC}0 + K \cdot DP$). By the processes in steps 526 to 532, if the time differentiation value $\Delta P_r$ of the intake pressure is less than 0, the control amount $G_{ISC}0$ which was set at the preceding control timing is directly set as a control amount $G_{ISC}$. If the time differentiation value $\Delta P_r$ of the intake pressure is equal to or larger than 0, the intake pressure deviation DP is increased by a predetermined number (K) of times, the resultant value is added to the control amount $G_{ISC}0$ which was set at the preceding control timing, and the resultant value is set as a control amount $G_{ISC}$.

Steps 534 to 540 relate to a guarding process of the control amount $G_{ISC}$ in the case during the arming up or running. In step 534, a check is made to see if the engine is in the warming up or running state or not. If the engine is not in the warming up or running state, step 542 follows.

On the other hand, if the engine is in the warming-up or running state in step 534, step 536 follows. The predetermined control amount $G_{LRN}$ is set in accordance with the load state in a manner similar to step 508. In step 538, a check is made to see if the control amount $G_{ISC}$ which was set in step 532 is less than the predetermined control amount $G_{LRN}$ or not. If the control amount $G_{ISC}$ is equal to or larger than the predetermined control amount $G_{LRN}$, step 542 follows. If the control amount $G_{ISC}$ is less than the predetermined control amount $G_{LRN}$ in step 538, step 540 follows. In step 540, the control amount $G_{ISC}$ is reset to the predetermined control amount $G_{LRN}$ and step 542 follows.

Figure 12:
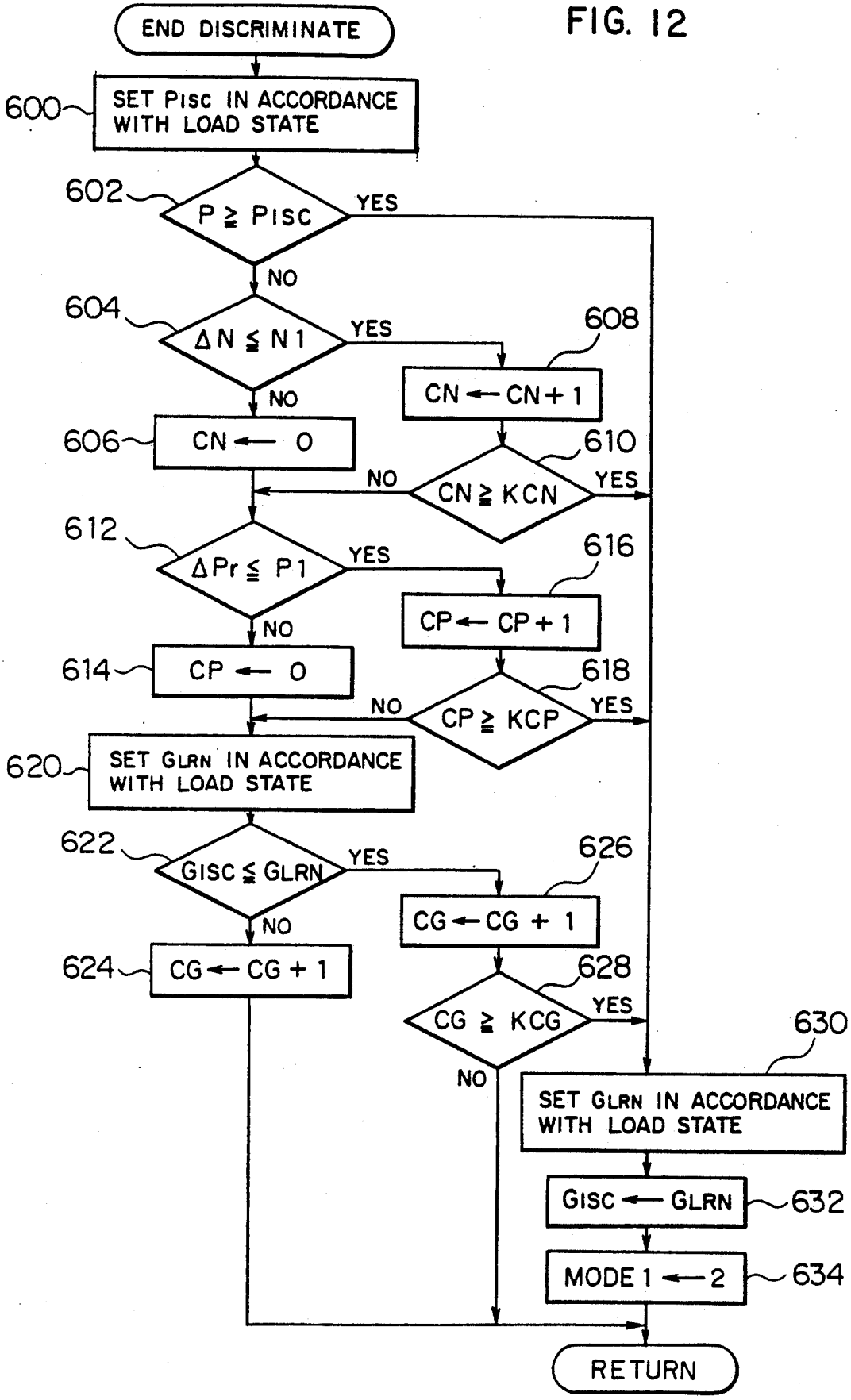

Step 542 relates to an end discriminating process. The end discriminating process will now be described on the basis of a flowchart shown in FIG. 12. In step 600 a predetermined intake pressure $P_{ISC}$ is set in accordance with the load state of the engine 10. IN detail, as will be explained hereinlater, the learning intake pressure corresponding to the load state at that time among the learning intake pressures $P_{LRN1}$, $P_{LRN2}$, and $P_{LRN3}$ stored in the BU-RAM 54 is set as a predetermined intake pressure $P_{ISC}$ in accordance with the load state. In step 602, if the intake pressure P is equal to or larger than the predetermined intake pressure $P_{ISC}$, step 628 follows. On the other hand, in step 602, if the intake pressure P is less than the predetermined intake pressure $P_{ISC}$, step 604 follows.

In step 604, a check is made to see if the time differentiation value ΔN of the rotational speed is equal to or less than a first predetermined value $N_1$ or not. If the time differentiation value ΔN of the rotational speed is larger than the first predetermined value $N_1$, step 606 follows. In step 606, a counter CN is reset (CN←0) and step 612 follows. The counter CN is used to detect a continuation time of a state in which the time differentiation value ΔN of the rotational speed is equal to or less than the first predetermined value $N_1$.

On the other hand, in step 604, if the time differentiation value ΔN of the rotational speed is equal to or less than the first predetermined value $N_1$, step 608 follows and the counter CN is counted up ($CN \leftarrow CN + 1$). In step 610, a check is made to see if the count value of the counter CN is equal to or larger than a first count value KCN or not, that is, whether a continuation time of a sate in which the time differentiation value ΔN of the rotational speed is equal to or less than the first predetermined value $N_1$ is equal to or longer than a first predetermined time or not. If the count value of the counter CN is equal to or larger than the first count value KCN, step 628 follows. On the contrary, if the count value of the counter CN is less than the first count value KCN in step 610, step 612 follows.

In step 612, a check is made to see if the time differentiation value $\Delta P_r$ of the intake pressure is equal to or less than a second predetermined value $P_1$ or not. If the time differentiation value $\Delta P_r$ of the intake pressure is larger than the second predetermined value $P_1$, step 614 follows. In step 614, a counter CP is reset (CP←0) and step 620 follows. The counter CP detects a continuation time of a state in which the time differentiation value $\Delta P_r$ of the intake pressure is equal to or less than the second predetermined value $P_1$.

On the other hand, in step 612, if the time differentiation value $\Delta P_r$ of the intake pressure is equal to or less than the second predetermined value $P_1$, step 616 follows and the counter CP is counted up ($CP \leftarrow CP+1$). In step 618, a check is made to see if the value of the counter CP is equal to or larger than a second count value KCP or not, that is, whether a continuation time of a state in which the time differentiation value $\Delta P_r$ of the intake pressure is equal to or less than a second predetermined value $P_1$ is equal to or longer than a second predetermined time or not. If the count value of the counter CP is equal to or larger than the second count value KCP, step 628 follows. On the contrary, if the value of the counter CP is less than the second count value KCP in step 618 step 620 follows.

Figure 11:
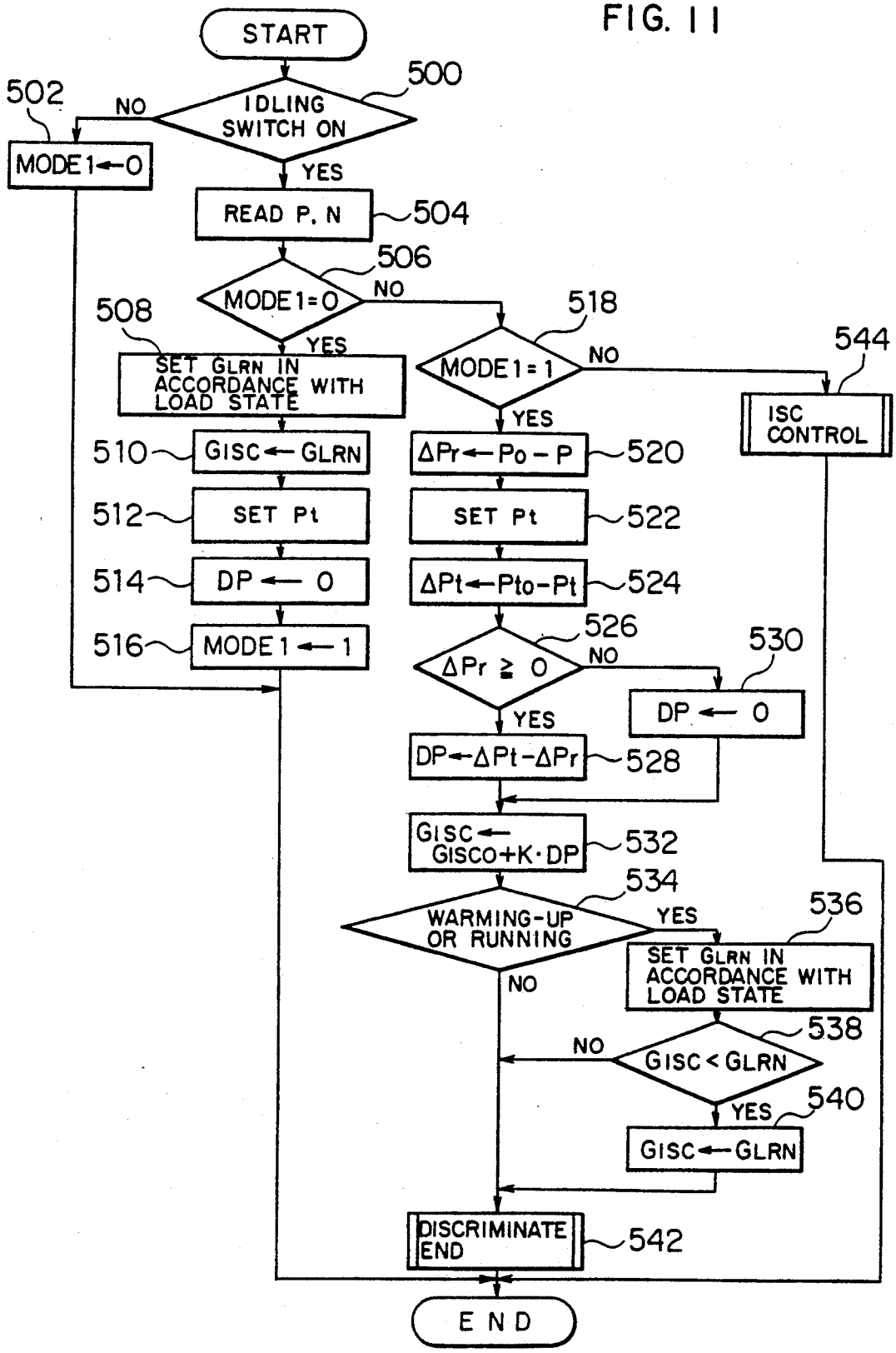
FIGS. 11 to 15 are flowcharts for explaining the operation of the fifth embodiment.

In step 620, the predetermined control amount $G_{LRN}$ is set in accordance with the load state of the engine 10 in a manner similar to step 508 in FIG. 11 mentioned above. In step 622, a check is made to see if the control amount $G_{ISC}$ is equal to or less than the predetermined control amount $G_{LRN}$ or not. If the control amount $G_{ISC}$ is larger than the predetermined control amount $G_{LRN}$, step 624 follows. In step 624, a counter CG is reset (CG←0) and the processing routine is finished. The counter CG detects a continuation time of a state in which the control amount $G_{ISC}$ is equal to or less than the predetermined control amount $G_{LRN}$.

On the other hand, in step 622, if the control amount $G_{ISC}$ is equal to or less than the predetermined control amount $G_{LRN}$, step 626 follows and the counter CG is counted up ($CG \leftarrow CG+1$). In step 628, a check is made to see if the count value of the counter CG is equal to or larger than a third count value KCG or not, namely, whether a continuation time of a state in which the control amount $G_{ISC}$ is equal to or less than the predetermined control amount $G_{LRN}$ is equal to or longer than a third predetermined time or not. If the value of the counter CG is equal to or larger than the third count value KCG, step 630 follows. On the other hand, in step 628, if the value of the counter CG is less than the third count value KCG, the processing routine is finished.

Steps 630 to 634 relate to a finishing routine which is executed when it is determined that the deceleration control is finished. In step 630, the predetermined control amount $G_{LRN}$ is set in accordance with the load state of the engine 10 in a manner similar to step 620 mentioned above and step 632 follows. In step 632, the control amount $G_{ISC}$ is reset to the predetermined control amount $G_{LRN}$ ($G_{ISC} \leftarrow G_{LRN}$) and step 634 follows. In step 634, the flag MODE1 is set to 2 (MODE1←2). If the flag MODE1 has been set to 2, this means that the idling control (ISC control) is executed. The description of the end discriminating process in step 542 in FIG. 11 is finished.

Figure 13:
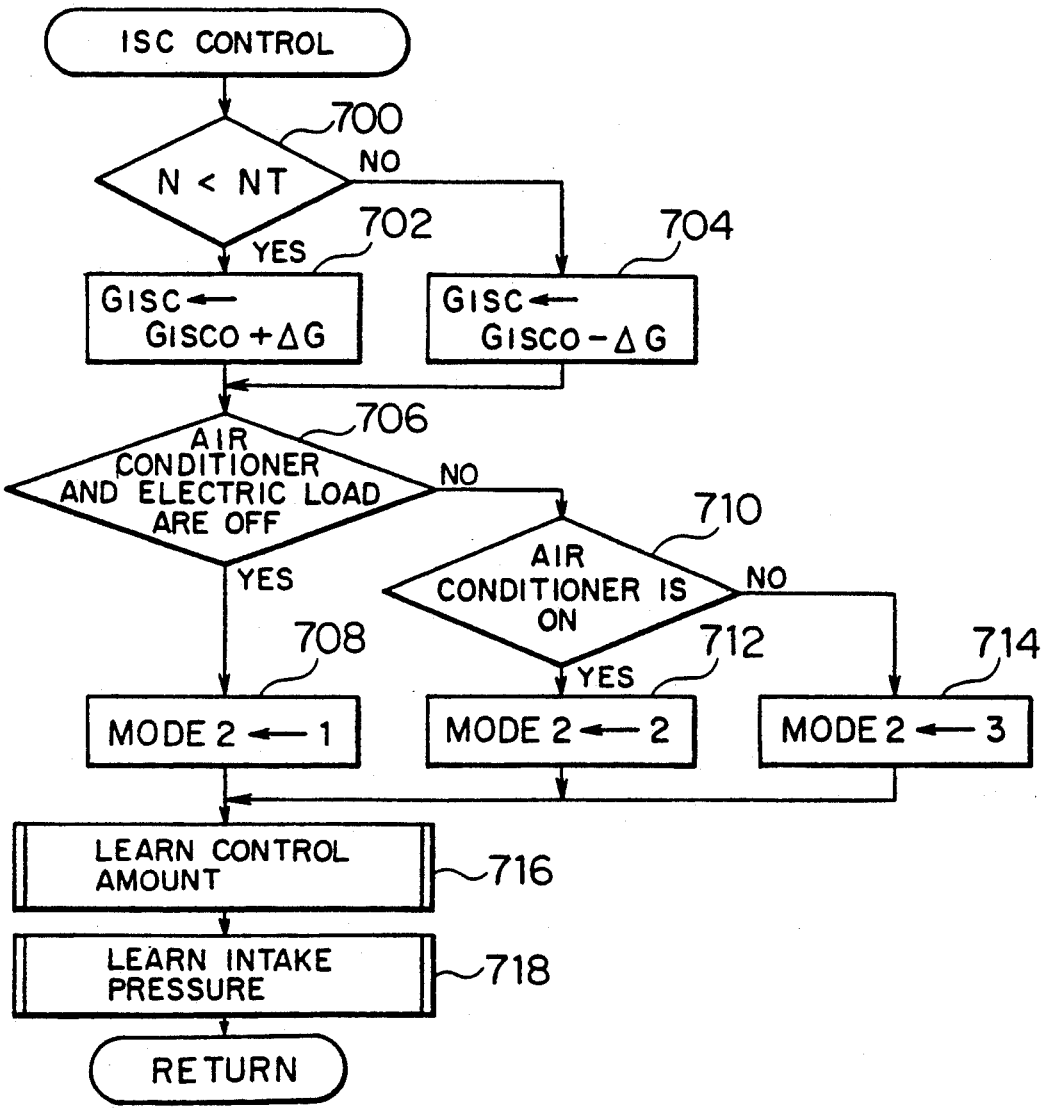

Returning to FIG. 11, in step 518, if the flag MODE1 is not 1, that is, if the flag MODE1 has been set to 2, step 544 follows and the ISC control is executed. The ISC control in step 544 will no be described hereinbelow on the basis of a flowchart shown in FIG. 13.

Steps 700 to 704 relate to a processing routine to set the control amount $G_{ISC}$ in a manner such that the rotational speed N coincides with a target rotational speed NT which is set in accordance with the engine state such as a water temperature or the like. In step 700, a check is made to see if the rotational speed N is less than the target rotational speed NT or not. If the rotational speed N is less than the target rotational speed NT, step 702 follows. In step 702, only a predetermined amount ΔG is added to the control amount $G_{ISC}0$ which was set at the preceding control timing and the resultant value is set as the control amount $G_{ISC}$ and step 706 follows. In step 700, a check is made to see if the rotational speed N is less than the target rotational speed NT or not. If the rotational speed N is equal to or larger than the target rotational speed NT, step 704 follows. In step 704, only a predetermined amount ΔG is subtracted from the control amount $G_{ISC}0$ which was set at the preceding control timing and the resultant value is set as the control amount $G_{ISC}$ and step 706 follows.

Steps 706 to 714 relate to a processing routine to detect the load state of the engine 10. In step 706, states of the air conditioner and the electric load are detected. If both of the air conditioner and the electric load are off, step 708 follows. In step 708, a flag MODE2 is set to 1 (MODE2←1) and step 716 follows. The flag MODE2 shows the load state of the engine 10. On the other hand, in step 706, the state of the air conditioner is detected. If the air conditioner is on, step 712 follows. In step 712, the flag MODE2 is set to 2 (MODE2←2) and step 716 follows. On the contrary, if the air conditioner is off in step 710, that is, in the case where only the electric load is applied to the engine 10, step 714 follows. In step 714, the flag MODE2 is set to 3 (MODE2←3) and step 716 follows.

Figure 14:
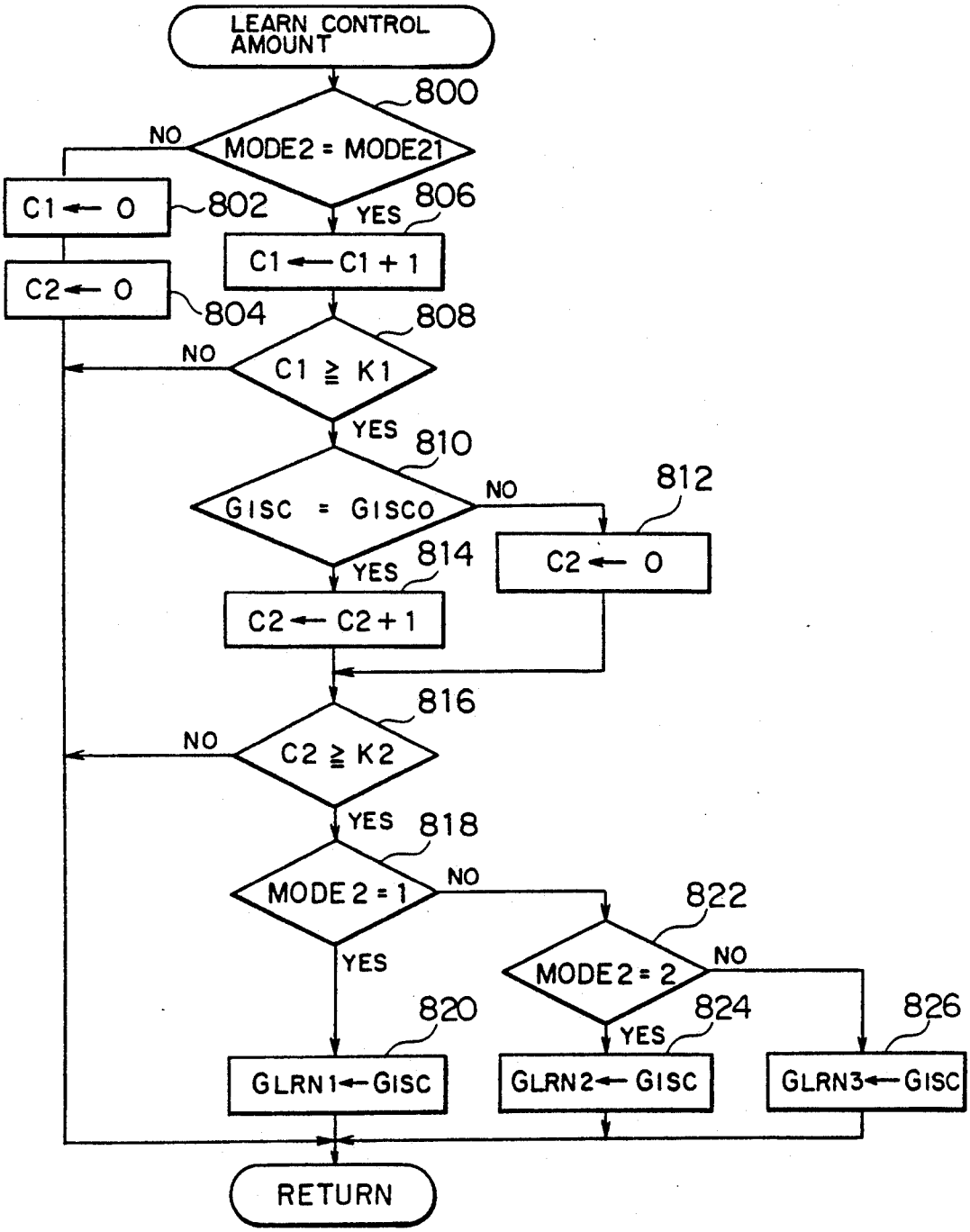

Step 716 relates to a processing routine to set the learning control amounts $G_{LRN1}$, $G_{LRN2}$, and $G_{LRN3}$ according to the load state. A learning control amount setting routine will now be described on the basis of a flowchart shown in FIG. 14. In step 800, a check is made to see if the content of the flag MODE2 is equal to the content of a flag MODE21 at the preceding control timing or not. If the content of the flag MODE2 differs from the content of the flag MODE21 at the preceding control timing, step 802 follows. In step 802, a counter $C_1$ is reset ($C_1 \leftarrow 0$) and step 804 follows. The counter $C_1$ is used to measure a continuation time from the present load state. In step 804, a counter $C_2$ is reset ($C_2 \leftarrow 0$) and the control routine is finished. The counter $C_2$ is used to measure the continuation time of the present control amount $G_{ISC}$.

On the other hand, in step 800, if the content of the flag MODE2 is equal to the content of the flag MODE21 at the preceding control timing, step 806 follows. In step 806, the value of the counter $C_1$ is counted up ($C_1 \leftarrow C_1+1$) and step 808 follows. In step 808, a check is made to see if the value of the counter $C_1$ is equal to or larger than the predetermined value $K_1$ or not, that is, whether a predetermined time or longer has elapsed after the present load state had been set or not. If the value of the counter $C_1$ is less than the predetermined value $K_1$, the processing routine is finished.

On the other hand, if the value of the counter $C_1$ is equal to or larger than the predetermined value $K_1$ in step 808, step 810 follows. In step 810, a check is made to see if the control amount $G_{ISC}$ is equal to the control amount $G_{ISC}0$ at the preceding control timing or not. If the control amount $G_{ISC}$ differs from the control amount $G_{ISC}0$ at the preceding control timing, step 812 follows. In step 812, the counter $C_2$ is reset ($C_2 \leftarrow 0$) and step 816 follows. On the other hand, in step 810, if the control amount $G_{ISC}$ is equal to the control amount $G_{ISC}0$ at the preceding control timing, step 814 follows. In step 814, the counter $C_2$ is counted up ($C_2 \leftarrow C_2+1$) and step 816 follows.

In step 816, a check is made to see if the value of the counter $C_2$ is equal to or larger than the predetermined value $K_2$ or not, that is, whether a predetermined time or longer has elapsed after the present control amount $G_{ISC}$ had been set or not. If the value of the counter $C_2$ is less than the predetermined value $K_2$, the processing routine is finished. On the other hand, in step 816, if the value of the counter $C_2$ is equal to or larger than the predetermined value $K_2$, step 818 follows.

Steps 818 to 826 relate to an updating routine of the learning control amount. In step 818, a check is made to see if the flag MODE2 has been set to 1 or not. If the flag MODE2 has been set to 1, step 820 follows. In step 820, the learning control amount $G_{LRN1}$ corresponding to the load state in which none of the air conditioner and the electric load is applied is updated into the present control amount $G_{ISC}$ ($G_{LRN1} \leftarrow G_{ISC}$) and the processing routine is finished. On the other hand, in step 818, if the flag MODE2 is not set to 1, step 822 follows. In step 822, a check is made to see if the flag MODE2 has been set to 2 or not. If the flag MODE2 has been set to 2, step 824 follows. In step 824, the learning control amount $G_{LRN2}$ corresponding to the load state in which the air conditioner is on is updated into the present control amount $G_{ISC}$ ($G_{LRN2} \leftarrow G_{ISC}$) and the processing routine is finished. On the other hand, n step 822, if the flag MODE2 is not set to 2, that is, if the flag MODE2 has been set to 3, step 826 follows. In step 826, the learning control amount $G_{LRN3}$ corresponding to the load state in which only the electric load is applied is updated into the present control amount $G_{ISC}$ ($G_{LRN3} \leftarrow G_{ISC}$) and the processing routine is finished.

Figure 15:
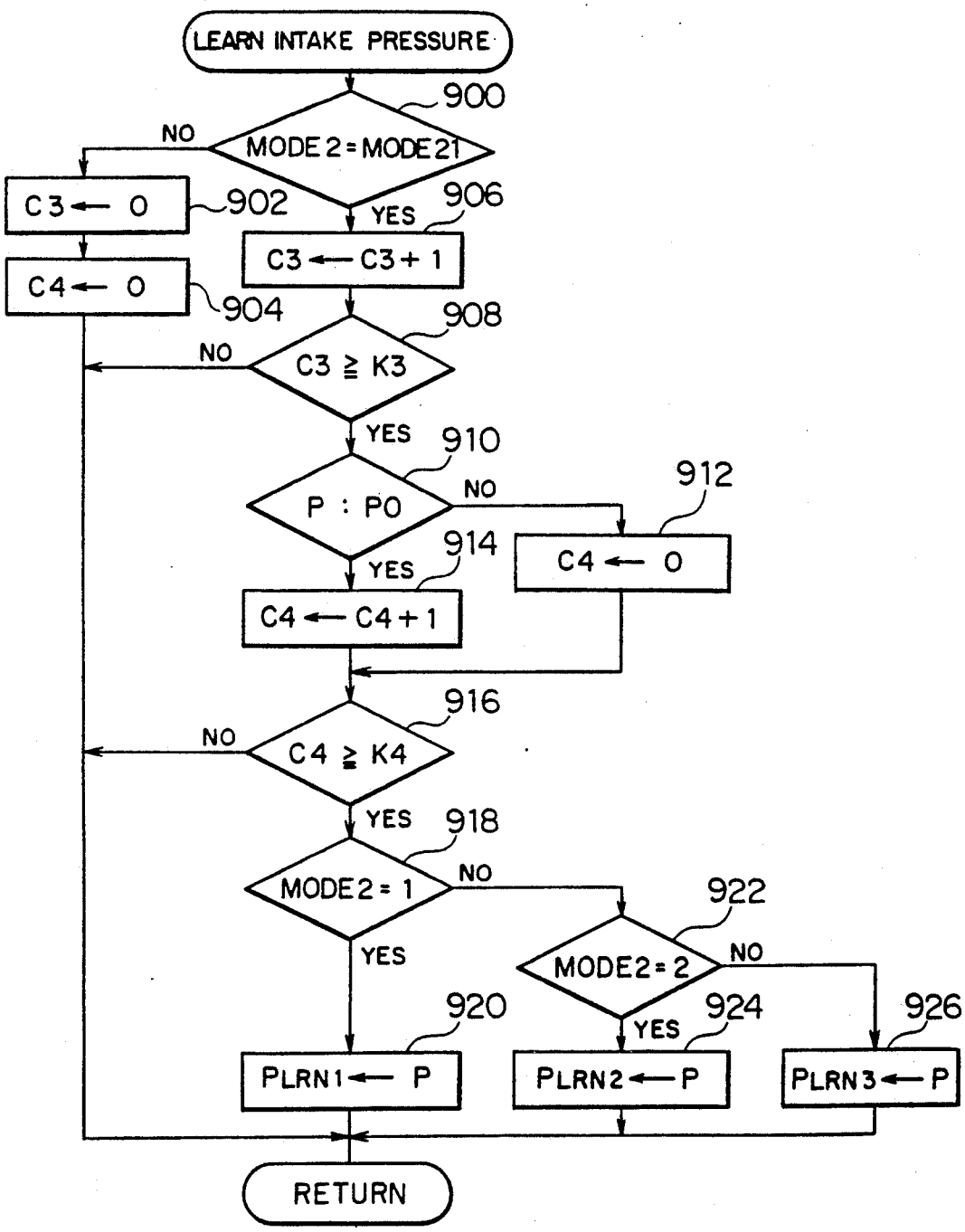

Returning to FIG. 13, the subsequent step 718 relates to a processing routine to set learning intake pressures $P_{LRN1}$, $P_{LRN2}$, and $P_{LRN3}$ corresponding to the load state. A learning intake pressure setting routine will be described on the basis of a flowchart shown in FIG. 15. In step 900, a check is made to see if the content of the flag MODE2 is equal to the content of the flag MODE21 at the preceding control timing or not. If the content of the flag MODE2 differs from the content of the flag MODE21 at the preceding control timing, step 902 follows. In step 902, a counter $C_3$ is reset ($C_3 \leftarrow 0$) and step 904 follows. The counter $C_3$ is used to measure a continuation time of the present load state. In step 904, a counter $C_4$ is reset ($C_4 \leftarrow 0$) and the control routine is finished. The counter $C_4$ is used to measure a continuation time of the present intake pressure P.

In step 900, if the content of the flag MODE2 is equal to the content of the flag MODE21 at the preceding control timing, step 906 follows. In step 906, the counter $C_3$ is counted up ($C_3 \leftarrow C_3+1$) and step 908 follows. In step 908, a check is made to see if the value of the counter $C_3$ is equal to or larger than a predetermined value $K_3$ or not, that is, whether a predetermined time or longer has elapsed after the present load state has been set or not. If the value of the counter $C_3$ is less than the predetermined value $K_3$, the processing routine is finished.

On the other hand, if the value of the counter $C_3$ is equal to or larger than the predetermined value $K_3$ in step 908, step 910 follows. In step 910, a check is made to see if the intake pressure P is equal to the intake pressure P0 at the preceding control timing or not. If the intake pressure P differs from the intake pressure P0 at the preceding control timing, step 912 follows. In step 912, the counter $C_4$ is reset ($C_4 \leftarrow 0$) and step 916 follows. On the other hand, in step 910, if the intake pressure P is equal to the intake pressure P0 at the preceding control timing, step 914 follows. In step 914, the counter $C_4$ is counted up ($C_4 \leftarrow C_4+1$) and step 916 follows.

In step 916, a check is made to see if the value of the counter $C_4$ is equal to or larger than a predetermined value $K_4$ or not, that is, whether a predetermined time or longer has elapsed after the present intake pressure P has been set or not. If the value of the counter $C_4$ is less than the predetermined value $K_4$, the processing routine is finished. On the contrary, in step 916, if the value of the counter $C_4$ is equal to or larger than the predetermined value $K_4$, step 918 follows.

Steps 918 to 926 relate to an updating routine of the learning intake pressure. In step 918, a check is made to see if the flag MODE2 has been set to 1 or not. If the flag MODE2 has been set to 1, step 920 follows. In step 920, the learning intake pressure $P_{LRN1}$ corresponding to the load state in which none of the air conditioner and the electric load is applied is updated into the present intake pressure P ($P_{LRN1} \leftarrow P$) and the processing routine is finished. If the flag MODE2 is not set to 1 in step 918, step 922 follows. In step 922, a check is made to see if the flag MODE2 has been set to 2 or not. If the flag MODE2 has been set to 2, step 924 follows. In step 924, the learning intake pressure $P_{LRN2}$ corresponding to the load state in which the air conditioner is on is updated into the present intake pressure P ($P_{LRN2} \leftarrow P$) and the processing routine is finished. On the other hand, in step 922, if the flag MODE2 is not set to 2, that is, if the flag MODE2 has been set to 3, step 926 follows. In step 926, the learning intake pressure $P_{LRN3}$ corresponding to the load state in which only the electric load is applied is updated into the present intake pressure P ($P_{LRN3} \leftarrow P$) and the processing routine is finished.

We claim:

1. A rotational speed control apparatus of an engine, comprising:

speed detecting means for detecting a rotational speed of said engine;

control start time detecting means for detecting a control start time in accordance with a decelerating state of said engine;

intake information detecting means for detecting intake information of said engine;

target engine speed updating means for updating a target rotational speed every predetermined period in accordance with an amount of change in said rotational speed per time at said control start time;

storage means for storing a predetermined stored relationship between the engine rotational speed and intake information when an amount of intake air is constant and when an engine operating condition is changed from a non-idling state to an idling state;

target value setting means, responsive to data of said storage means, for setting a target value of the intake information corresponding to the engine rotational speed detected by said speed detecting means;

control amount setting means for setting a control amount in accordance with said target value of intake information and said intake information; and an actuator for adjusting an intake amount in accordance with said control amount.

2. An apparatus according to claim 1, wherein the intake information detecting means has intake manifold pressure detecting means for detecting a pressure of an intake manifold on the downstream side of a throttle valve of the engine.

3. An apparatus according to claim 2, wherein said control start timing detecting means has second discriminating means for determining that a time to start the control has come when said time change amount of said intake manifold pressure is equal to or larger than 0.

4. An apparatus according to claim 2, wherein said control amount setting means has second control end discriminating means for determining that a timing to finish said control has come when a state in which the time change amount of the intake manifold pressure is equal to or less than a second predetermined value continues for a second predetermined time or longer.

5. An apparatus according to claim 2 wherein said control amount setting means has fourth control end discriminating means for determining that a timing to finish the control has come when the intake manifold pressure is equal to or larger than a predetermined pressure.

6. An apparatus according to claim 5, wherein said fourth control end discriminating means comprises:

idling control amount setting means for setting a control amount of the actuator in accordance with the engine speed so that the engine speed coincides with the target engine speed in an idling state of said engine;

load state detecting means for detecting means for detecting an idling stable state;

intake manifold pressure memory means for storing said intake manifold pressure when the idling stable was detected in accordance with said load state; and predetermined intake manifold pressure setting means for setting the predetermined intake manifold pressure for said intake manifold pressure stored in accordance with said load state.

7. An apparatus according to claim 1, wherein said control amount setting means sets said control amount in accordance with a time change amount of said intake information.

8. An apparatus according to claim 1, wherein said control amount setting means comprises:

first control amount calculating means for calculating the control amount in accordance with a deviation between said target value and said intake information and a first proportional value when said intake information is equal to or smaller than said target value; and second control amount calculating means for calculating the control amount in accordance with said deviation between said target value and said intake information and a second proportional value smaller than said first proportional value when said intake information is larger than said target value.

9. An apparatus according to claim 1, wherein said actuator has:

an auxiliary air passage which is arranged in an intake manifold to bypass a throttle valve; and an idling control valve for adjusting an auxiliary air amount which is supplied form said auxiliary air passage to said engine.

10. An apparatus according to claim 1, wherein said control start timing detecting means has first discriminating means for determining that a timing to start the control has come when a throttle valve is in a fully closed state and an operating mode which was previously in a fuel cutting state to the engine has become a non fuel-cutting state.

11. An apparatus according to claim 1, wherein said control amount setting means has first control end discriminating means for determining that a time to finish said control has come when a state in which the time change amount of the engine speed is equal to or less than a first predetermined value continues for a first predetermined time or longer.

12. An apparatus according to claim 1, wherein said control amount setting means has third control end discriminating means for determining that a timing to finish the control has come when a state in which the control amount is equal to or less than a predetermined control amount continues for a third predetermined time or longer.

13. An apparatus according to claim 12, wherein the third control end discriminating means comprises:

idling control amount setting means for setting a control amount of said actuator in accordance with said engine speed so that the engine speed coincides with said target engine speed in an idling state of said engine;

load state detecting means for detecting a load state of the engine;

stable state detecting means for detecting an idling stable state;

control amount memory means for storing the idling control amount when said idling stable state is detected in accordance with the load state; and predetermined control amount setting means for setting the predetermined control amount for the idling control amount stored in accordance with said load state.

14. An apparatus according to claim 1, wherein the control amount setting means comprises:

idling control amount setting means for setting a control amount of the actuator in accordance with said engine speed so that said engine speed coincides with said target engine speed in an idling state of said engine;

load state detecting means for detecting a load state of said engine;

stable state detecting means for detecting said idling stable state;

control amount memory means for storing said idling control amount when said idling stable state was detected in accordance with said load state;

predetermined control amount setting means for setting said predetermined control amount for said idling control amount stored in accordance with said load state;

lower limit value setting means for setting a lower limit value of said control amount in accordance with said predetermined control amount;

warming-up detecting means for detecting whether said engine is in a warming-up state or not;

running state detecting means for detecting whether said engine is in a running state or not; and control amount resetting means for resetting said control amount for said lower limit value when said control amount is equal to or lower than said limit value in a state in which either one of the engine warming-up state and the running state was detected.

15. An auxiliary air amount control apparatus of an engine, comprising:

an auxiliary air passage for leading auxiliary air from an upstream position of a throttle valve to a downstream position of the throttle valve by bypassing the throttle valve provided in an intake pipe of said engine;

an actuator disposed in said auxiliary air passage for adjusting a flow rate of said auxiliary air;

intake pressure detecting means for detecting an intake pressure;

engine rotational speed detecting means for detecting an engine rotational speed;

storage means for storing a relationship between the engine rotational speed and the intake pressure when an amount of intake air is constant and when an engine operating condition is changed from a non-idling state to an idling state;

target intake pressure setting means for accessing said storage means to a target intake pressure corresponding to the engine rotational speed detected by said engine rotational speed detecting means; and actuator control means for controlling said actuator so that the target intake pressure set by said target intake pressure setting means and the intake pressure detected by said intake pressure detecting means are coincident with each other by feedback control in accordance with a deviation of the detected intake pressure from the target intake pressure.

16. An auxiliary air amount control apparatus of an engine, comprising:

an auxiliary air passage for leading auxiliary air from an upstream position of a throttle valve to a downstream position of the throttle valve by bypassing the throttle valve provided in an intake pipe of said engine;

an actuator disposed in said auxiliary air passage for adjusting a flow rate of said auxiliary air;

intake pressure detecting means for detecting an intake pressure;

engine rotational speed detecting means for detecting an engine rotational speed;

storage means for storing a relationship between the engine rotational speed and the intake pressure when an amount of intake air is constant and when an engine operating condition is changed from a non-idling state to an idling state;

target intake pressure setting means, by using data of said storage means, for setting a target intake pressure corresponding to the engine rotational speed detected by said engine rotational speed detecting means; and actuator control means for controlling said actuator so that a time differentiation value of the target intake pressure set by said target intake pressure setting means and a time differentiation value of the intake pressure detected by said intake pressure detecting means are coincident with each other by feedback control in accordance with a deviation of the detected intake pressure from the target intake pressure.

17. An auxiliary air amount control apparatus of an engine, comprising:

an auxiliary air passage for leading auxiliary air from an upstream position of a throttle valve to a downstream position of the throttle valve by bypassing the throttle valve provided in an intake pipe of said engine;

an actuator disposed in said auxiliary air passage for adjusting a flow rate of said auxiliary air;

intake pressure detecting means for detecting an intake pressure;

engine rotational speed detecting means for detecting an engine rotational speed;

storage means for storing a relationship between the engine rotational speed and the intake pressure when an amount of intake air is constant and when an engine operating condition is changed from a non-idling state to an idling state;

ideal rotational speed estimating means for estimating an ideal rotational speed from a gradient of an engine rotational speed just before the engine is returned from a fuel cutting mode, said ideal rotational speed representing an ideal behavior of the rotational speed during deceleration in which a target rotational speed in a stable idling state is reached while retaining the gradient of the engine rotational speed just before the engine is returned from the fuel cutting mode;

target intake pressure setting means, by using data of said storage means, for setting a target intake pressure corresponding to the estimated engine rotational speed by said ideal rotational speed estimating means; and actuator control means for controlling said actuator so that a time differentiation value of the target intake pressure set by said target intake pressure setting means and a time differentiation value of the intake pressure detected by said intake pressure detecting means are coincident with each other by feedback control in accordance with a deviation of the detected intake pressure from the target intake pressure.

* * * * *